United States Patent [19]

O'Grady

[11] 4,033,318

[45] July 5, 1977

[54] SPRING TYPE BALL PITCHING DEVICE

[76] Inventor: Thomas Raymond O'Grady, 2415 Stanford Ave., Fort Wayne, Ind. 46808

[22] Filed: Nov. 7, 1975

[21] Appl. No.: 629,692

[52] U.S. Cl. ..... 124/7; 124/41 R; 124/36

[51] Int. Cl.[2] ..... F41B 3/04

[58] Field of Search ..... 124/7, 8, 6, 4, 41 R, 124/36, 40, 81

[56] References Cited

UNITED STATES PATENTS

| | | | |
|---|---|---|---|
| 307,149 | 10/1884 | Teipel et al. | 124/7 |
| 1,017,272 | 2/1912 | Swain | 124/7 |
| 2,700,379 | 1/1955 | Brigati | 124/7 |
| 3,261,340 | 7/1966 | Laird | 124/7 |
| 3,552,371 | 1/1971 | Kahelin | 124/7 |
| 3,777,733 | 12/1973 | Mitchell | 124/7 |
| 3,838,676 | 10/1974 | Kahelin | 124/81 X |

*Primary Examiner*—Richard C. Pinkham
*Assistant Examiner*—William R. Browne

[57] ABSTRACT

A portable ground supported cage has a spring actuated bat rotatable to pitch a ball received in a cup at the small diameter end of the bat. The springs actuating the bat rotate the bat in a vertical plane to pitch the ball at the speed and trajectory required for batting practice. The bat is cocked and then held in a cocked position by a release handle which rotates between locking and unlocking position relative to the bat to permit its release and consequent pitching of the ball. The rotation of the bat is limited by the restricting of the spring after the bat has moved beyond a perpendicular position relative to the longitudinal axis of the machine.

10 Claims, 13 Drawing Figures

SPRING TYPE BALL PITCHING DEVICE

BACKGROUND OF THE INVENTION

Various pitching machines have been proposed in the past to give batters practice and to facilitate the coaching staff's desire to give batters experience with variously pitched balls at the plate. It is also proposed that a pitching machine be capable of duplicating a wide assortment of pitches, as well as speeds, so that the batter is given experience of a wide assortment of pitched balls.

The problem is how to provide a pitching device for baseball beginners and up to other higher skill levels as desired. Many beginning batters are uncomfortable at the plate because it appears as though the ball is going to hit them. What these batters need is enough exposure and experience at bat to overcome their initial fear of being hit. This can be achieved with a pitching machine which has a consistency of speed and trajectory of ball delivery. The young batter quickly familiarizes himself with a pitching situation and learns to gauge the speed and location of the ball and can very rapidly overcome concern of being hit and improve overall batting skill. But this takes practice.

Unfortunately, there are few, if any, inexpensive pitching devices which can suit the budget of organizations, such as Little League.

OBJECTS OF THE INVENTION

The object of the invention is to provide a portable pitching device which can pitch softballs or hardballs and deliver curves, sliders, sinkers, etc., at a determined speed and trajectory, and is especially adapted for beginning batters, although not necessarily limited to that use.

Another object of the invention is to devise a pitching device in which the throwing arm consists of a conventional bat which is spring loaded and adapted to pitch the ball with a consistency of speed and trajectory so that a beginning batter becomes readily accustomed to a batting position at the plate and with greater familiarity loses concern about being hit and quickly masters the art of timing and batting.

An important feature of the present invention is the spring arrangement and locking arrangement for the bat in which the springs serving as a loading device for actuating the bat also limit the bat movement after pitching the ball so that there are no requirements for an additional stop or other mechanism to limit bat movement. With respect to the locking mechanism, the important feature of the invention resides in the positive means for preventing accidental pitching of the ball, while at the same time, providing a ready means for releasing the bat from a cocked or loaded position.

Other objects and features of the present invention will become apparent from a consideration of the following description which proceeds with reference to the accompanying drawings.

DRAWINGS

Figure 11:
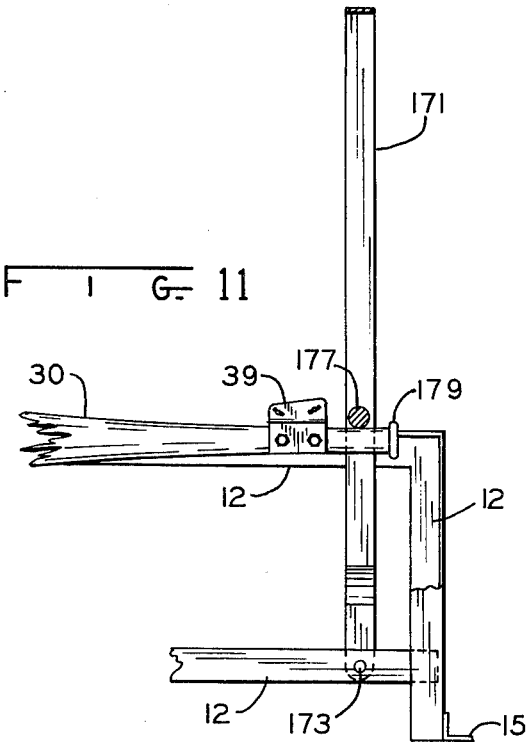
Figure 12:
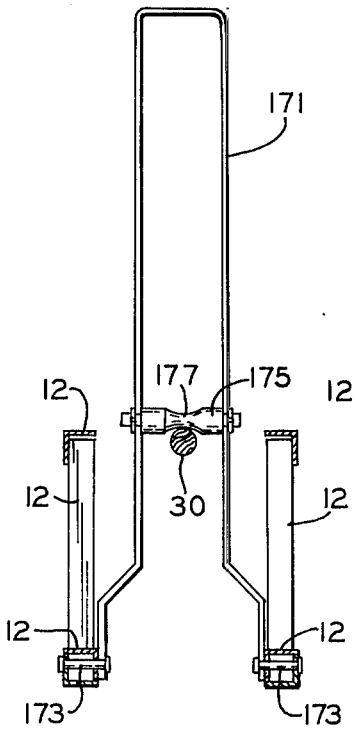
Figure 13:
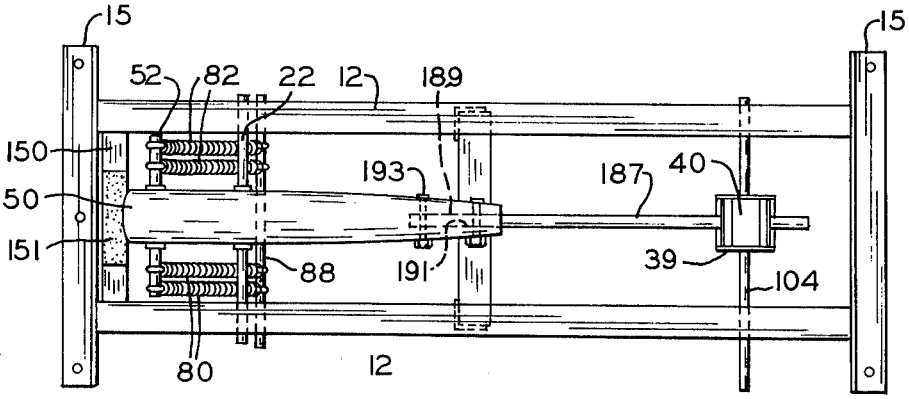

FIGS. 11 and 12 are front and side elevation views of a locking mechanism constituting a further embodiment of my invention in which a U-shaped locking element releasably holds the bat in its cocked position; and FIG. 13 is a plan view illustrating a further embodiment of the invention in which the small diameter end of the bat is substituted by a spring which receives the carrier and cup for the ball and thus imparts still a further pitching effect in which the spring at the end of the bat has a snapping action on the ball at the time of delivery.

SPECIFIC EXAMPLE EMBODIMENT

Referring now to the drawings, there is illustrated a frame designated generally by reference numeral 10 and consisting of a plurality of reinforcement members 12 and cross members 14 which are removable so that the frame can be shipped in a knocked down condition. The frame has base elements 15 with openings 17 which receive stakes 120 which are received through the opening 17 and are used to hold the frame positively in ground engagement and prevent the pitching unit designated generally by reference numeral 16 from "hopping" or "jumping" during pitching.

At the sides of the frame are two bearings 18 and 20 having an axle 22 which is mounted as indicated on bearings 18, 20.

Figure 4:
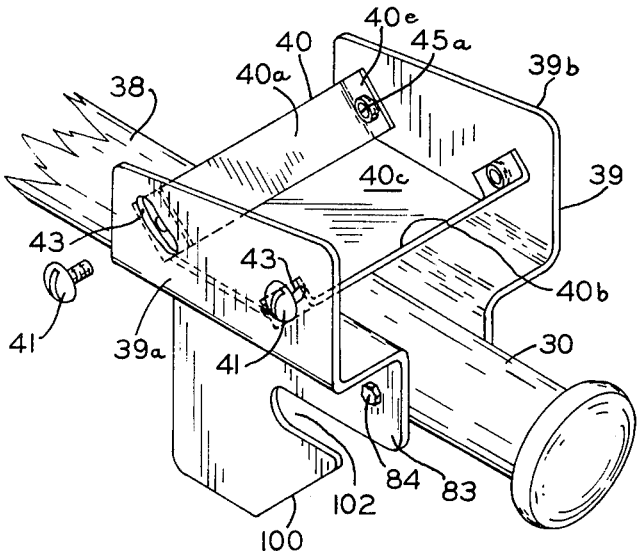
FIG. 4 is an enlarged isometric detail view of the carrier and cup for receiving the ball, said cup being adjustable relatively to the carrier.

A bat 30 with an opening 32 therein receives the axle 22 on which the bat 30 is caused to rotate. The bat 30 at the small diameter end 38 includes a carrier 39 with an adjustable cup 40 which is adjustable angularly relative to the carrier. Referring to FIG. 4, the cup 40 has inclined sides 40(*a*) and 40(*b*) and a base 40(*c*). The cup is angularly movable relative to the carrier 39 and to accomplish this, there are slots 43 in sides 39(*a*) and 39(*b*) of the carrier with screws 41 receivable one through each of the associated slots and threadedly received in a coacting threaded opening 45(*a*) in flanges 40(*e*) of sides 40(*a*) and 40(*b*). Thus, the cup is adjustable by loosening the screws, determining the cup position relative to the carrier and then retightening the screws. The cup is adapted for receiving the ball 42 therein.

At large diameter end 50 of the bat is a transverse pin 52 having opposite ends 56 and 58, each with spaced grooves 60 therein. The pin 52 is prevented from moving laterally once it is positioned transversely through opening 70 in the bat by means of washers 72 disposed one on each side of the bat and in contact therewith.

Two pairs of coil springs 80 and 82 are located one pair at each side of the bat and are fastened with one end 84 in a respective groove 60. The other end of each spring is secured to a cross pin 88 held at the bottom portion of the frame 10 in semi-circular base slots 201. There are several aligned sets of slots and the cross pin 88 is selectively located in one or the other of the slot pairs when the bat is uncocked and the springs 80, 82 are least extended. Thus, the force for rotating the bat 30 is selectively variable because the springs are variably tensioned when the bat is cocked. The cross pin 88 position determines the extent of spring loading and in turn produces the degreee of force desired for actuating the bat and thus establishes the speed of delivery on the ball 42.

The spring rate and size are so proportioned that when the bat 30 (FIGS. 1 and 2) is in a horizontal position, indicated in full lines, the springs are stretched, causing the bat to tend to be rotated about the axle 22 and pitching the ball 42 through the force of the pairs of springs 80, 82.

The bat 30 is held in a horizontal position by means of a locking device 96 (FIGS. 4 and 5) consisting of detent 98 received through the small diameter end 38 of the bat and having an inclined cam surface 100 with a notch 102 receiving a rod 104 spring loaded by spring 105 about hinge 106, causing the section 107 to enter the notch 102 and the spring 105 positively holds the rod in locked position with about five pounds force.

To release the bat and to allow the springs 80, 82 to effect rotation of the bat and hence pitching of the ball, all that is required is that handle 110 of rod 104 is manually gripped and the rod rotated about hinge 106 until the section 107 of rod 104 disengages from the notch 102 of the detent 98 thereby permitting the springs 80, 82 to pitch the ball.

There is no need for a stop for the bat since once rotation of the bat in a pitching direction causes the bat to go over center and releases the ball, tendency of the bat to continue to rotate is limited because the same springs become restretched. The bat then, after continuing its over-center pitching direction, is held by the same springs 80, 82 which then hold the bat against further movement in a pitching direction.

When it is desired to prepare the machine for a new pitch, the bat 30 is simply counterrotated to a horizontal position, the locking device being returned to locking position with the bat in its horizontal position and the bat 30 is then held in horizontal position in a "cocked" condition wherein the springs 80, 82 are restretched and can reactuate the bat to pitch the ball 42 in the cup 40 of carrier 39.

Figure 5:
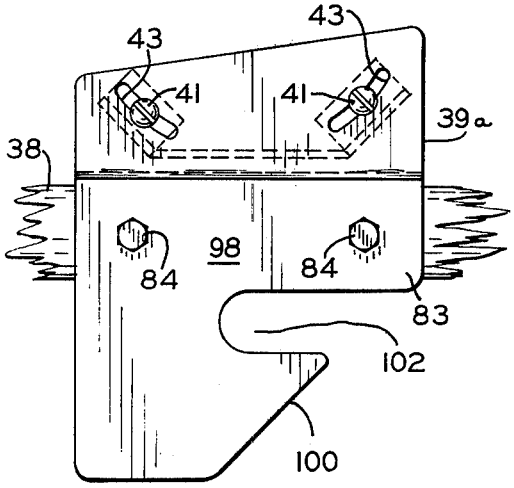
FIG. 5 is a side view of the carrier viewed from the lefthand side of FIG. 4.

As shown in FIGS. 4 and 5, the carrier 39 has an offset flange 83 which is secured through bolts 84 to the small diameter end of the bat 30.

Figure 6:
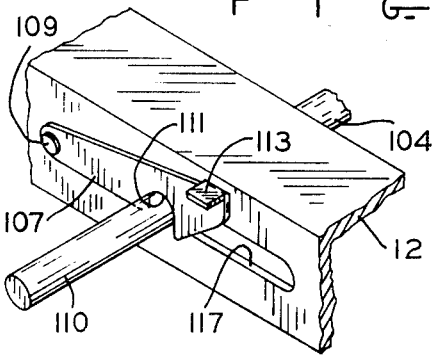
FIG. 6 is an isometric detail view of a latch for preventing accidental dislodgement of the locking rod.
Figure 7:
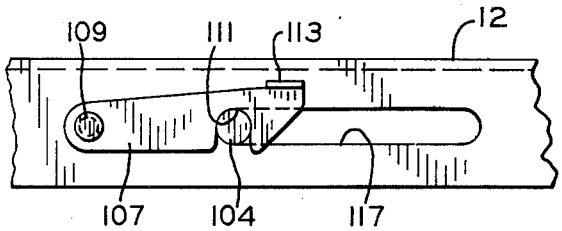
FIG. 7 is a side view looking from the lefthand side of FIG. 6.

A locking rod 104 (referring to FIGS. 6 and 7) prevents accidental actuating of the lever 104 by means of an additional locking pawl 107 which is pivoted at 109 and has a notch 111 which fits over rod 104. When it is desired to release the rod, the tab 113 is engaged by the thumb or finger of the operator causing the pawl 107 to rotate upwardly about 109 to disengage the pawl 107 from the rod 104, thereby permitting the rod 104 to move through elongated opening 117 to release the bat 30.

Figure 8:
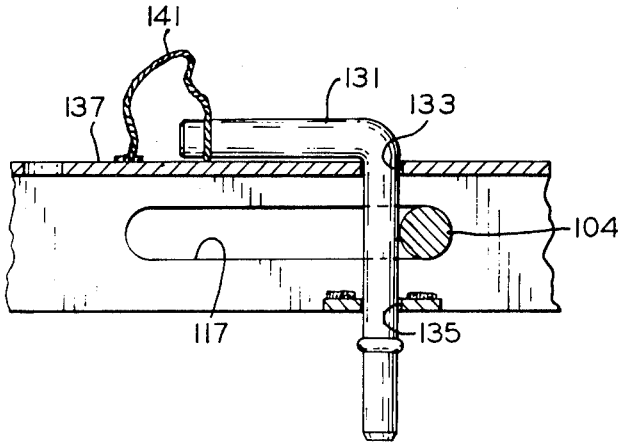
FIG. 8 is a further locking mechanism illustrating how the release rod is held against inadvertent movement by positive locking means and is held in a given position until removed.
Figure 9:
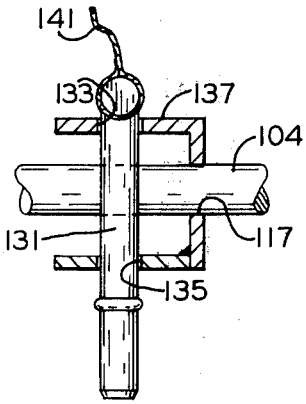
FIG. 9 is a detail view looking in the direction of arrows 9—9 in FIG. 8.

As a further precaution, referring to FIGS. 8 and 9, the rod 104 is mechanically locked in place by means of a locking rod 131 received through aligned openings 133 and 135 of frame member 137, thereby preventing movement of the rod 104 in a releasing direction until the locking rod 131 is lifted by means of handle section 139.

As a further safety feature, if there occurs an accidental release of the bat when no ball is in the cup, cross-piece 150 is fitted with a rubber stop 151 to prevent damage to the bat.

The locking rod 131 is secured to frame member 137 by means of a flexible strap or the like 141 so that it cannot be accidentally lost.

Figure 10:
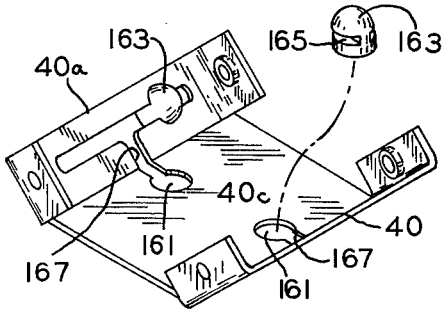
FIG. 10 illustrates how the cup can include removable and adjustable gripping elements to impart a spin to the ball as it is delivered in order to provide a variation of deliveries, as for example, sinkers, curves, etc., depending on the kind of ball spin which is in turn determined by the change in the position of the gripping elements.

Referring next to the embodiments shown in FIG. 10, within the cup 40, a key-shaped opening 161 receives a flexible grommet element 163 which engages the ball 42 when the ball 42 is fitted within the cup 40. Engagement of the grommet 163 (which includes a notch 165 for ease of insertion and removal from 161), imparts a spin on the ball and this grommet, together with a second grommet 165, variously located within T-shaped slot 167 in base 40(*c*) and side 40(*a*). By various combinations, the two grommets produce spins on the ball determining the kind of pitch, i.e. sinking, curve, slider, hop, etc.

Referring next to the embodiment shown in FIGS. 11 and 12, the release mechanism can be in the form of a U-shaped lever 171 pivoted at 173 including a roller 175 with an arcuate cross section recess 177 engageable with complementary opposing surface 179 of the bat so that when the release handle 171 is rotated clockwise about 173 (FIG. 11) it will disengage from the bat and at the last point of engagement with the bat, rides up and over the circular boss 179 at the end of the bat depressing the bat slightly just before release. This causes an abrupt release preceded by a slight downward biasing of the bat against the resistance of springs 80, 82.

In a still further embodiment of the invention, bat 30 can be modified by replacing the small diameter end 38 with a length of spring 187 which may be either rod or rectangular cross section strap. The end 189 of the spring is received within a socket 191 of the bat and is held therein in some suitable manner, as for example, through bolts or the like 193. The carrier 39 and cup 40 are then fastened to the spring so that the bat 30, instead of being solid, imparts a whipping action by means of the spring 187 which at the time of ball delivery closely proximates the pitching arm of a live pitcher.

Figure 1:
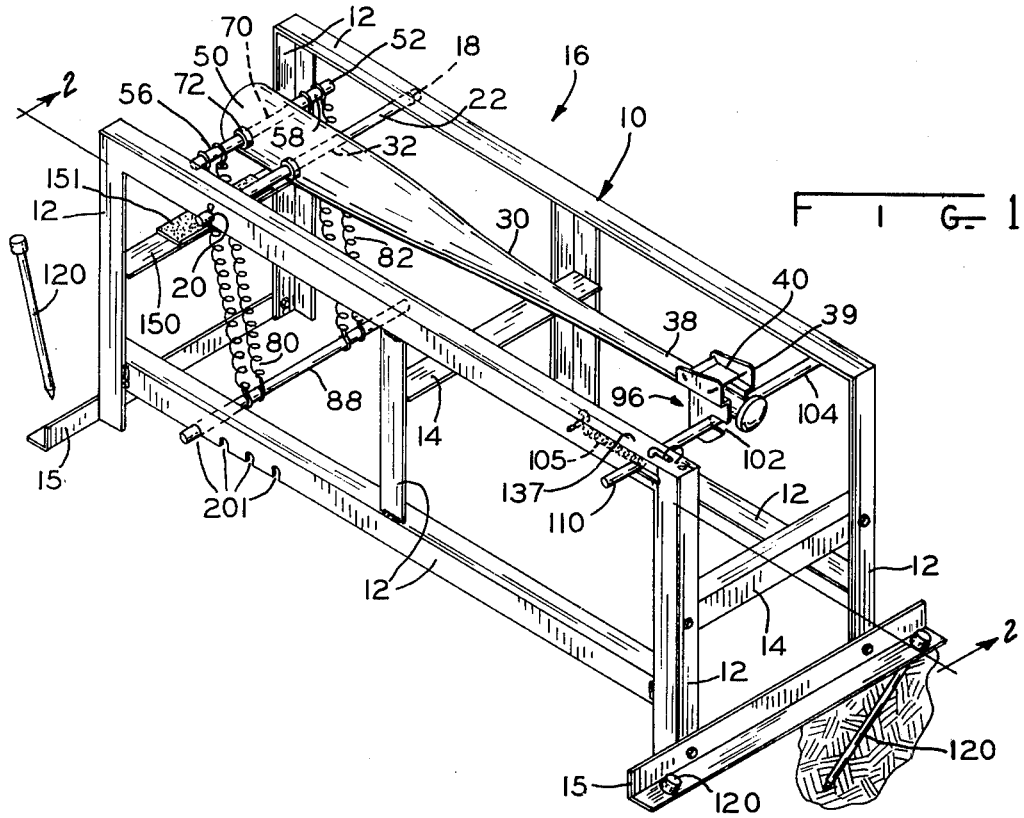
FIG. 1 is a perspective view of the device.
Figure 2:
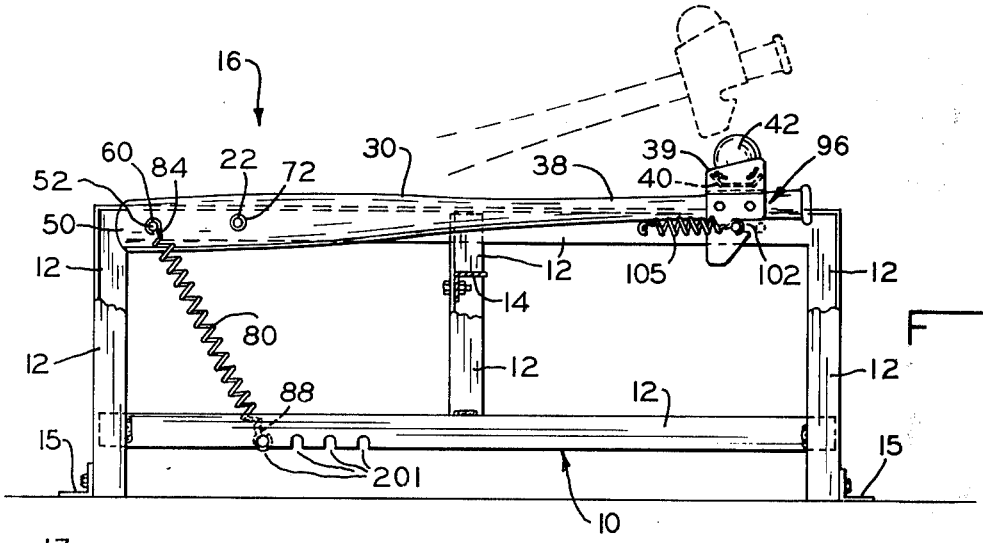
FIG. 2 is a side view of the device looking in the direction of arrows 2—2 in FIG. 1.
Figure 3:
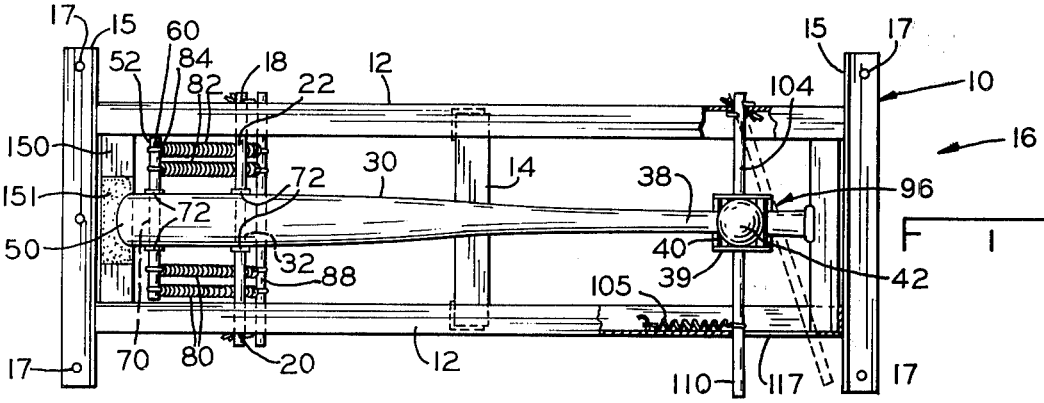
FIG. 3 is a plan view of the device.

As shown in FIGS. 1, 2 and 3, the springs 80, 82 can be variously stretched by selectively locating the cross pin 88 in any one of the pairs of aligned slots 201. Thus, when the bat is in an upright position, the operator can locate the rod 88 in any one of the preferred slot locations 201, thus determining the extent of spring extension and, therefore, biasing effort on the bat to vary the speed of the ball at the time of ball delivery.

OPERATION OF THE DEVICE

The device 16, located at the pitcher's mound or adjacent thereto, is fastened down by stakes 120 driven into the ground. The device is adjusted to the player's size, experience and pitching conditions by means of placement of rod 88 in slots 201 and the grommets 163, 165. The device is positioned and the springs adjusted as described to produce the speed, trajectory and kind of pitch designed to challenge the batter's ability.

In operation, the bat 30 is rotated about axle 22 to a horizontal position and so doing springs 80, 82 are stretched. Bat 30 is held in a horizontal position against the resistance of the springs by means of detent 98 (FIG. 4). The detent 98 biases rod 104 against the resistance of spring 105 and rotating pin 104 about hinge 106 by cam 100 until section 107 enters notch 102 preventing rotation of the bat 30 by springs 80, 82 in a pitching direction.

When it is desired to pitch the ball, the rod 104 is rotated in a releasing direction against the resistance of spring 105 which is stretched between pin 107 and rod 104, about pin 100 by manually gripping the handle 110 and rotating it in a direction to effect disengagement of the rod 104 within notch 102. At that instant, the springs 80, 82 forcibly rotate the bat, accelerating the ball 42 within the carrier 39 and cup 40 and pitching the ball towards the batter. The trajectory is relatively fixed and has been adjusted to give the height, speed, and path across the plate so that the batter will have an opportunity to hit it.

Immediately after delivery, the machine can be reset by counterrotating the bat 30 about 22 against the resistance of springs 80, 82 and relocking the bat in horizontal position with the springs 80, 82 stretched. The detent 98 locks the bat as before and the user inserts the same or another ball 42 into the cup of the carrier for a succeeding pitch.

The device is staked by stakes 120 to the ground so that pitches are more stable and the machine will not lurch out of position between successive pitches.

Although the present invention has been illustrated and described in connection with selected example embodiments, it will be understood that these are illustrative of the invention and are by no means restrictive thereof. It is reasonably to be expected that those skilled in this art can make numerous revisions and adaptations of the invention and it is intended that such revisions and adaptations will be included within the scope of the following claims as equivalents of the invention.

What I claim is:

1. A ball-pitching device comprising a rigid box-type frame, an axle serving as a fulcrum transversely mounted in said frame, a bat-shaped throwing arm having the larger diameter end mounted on said axle and comprisng a relatively short driving section and a relatively larger driven section comprised of the smaller diameter bat section and including a ball-holding device at the remote end of such driven section, extendable coil spring driving means disposed on each side of said throwing arm and fastened between a portion of said rigid box-type frame and the driving end of said bat to effect forcible rotation of said throwing arm about its fulcrum in a ball-throwing direction, said throwing arm being rotatable about its fulcrum by said spring driving means in a ball-throwing direction and the relationship between said spring-driving means and said throwing arm being such that throwing arm rotation is limited in its rotational movement only by the re-stretching of said coil spring driving means after the throwing arm has moved beyond a perpendicular position relatively to the longitudinal axis of the machine to obviate a positive stop for said throwing arm, said spring driving means being stretched to the maximum extent when said throwing arm is disposed horizontally with the ball received in said holding device, and locking means for holding said throwing arm in its horizontal firing position against the resistance of said stretched springs, said locking means being movable to a position releasing said throwing arm.

2. The ball-pitching device, in accordance with claim 1, including a transverse pin held by said frame wherein said throwing arm consists of a baseball bat and said coil spring driving means are constituted by heavy duty coil springs, each having an operative connection with said bat and said transverse pin and disposed one on each side of said bat, said locking means being constituted by a detent secured to said bat and a release lever effecting disengagement between said detent and said locking means and biased to a normal locking position.

3. The ball-pitching device, in accordance with claim 1, wherein said frame consists of a series of members braced together to provide a rigid box-like construction and disassembleable for shipping.

4. The ball-pitching device, in accordance with claim 1, in which said locking means includes a release handle constructed as an inverted U, pivot means for mounting said release handle on said frame at the lower end of said release handle and a roller and detent movable arcuately as said release handle is brought into locking position and movable arcuately out of engagement with the smaller diameter end of said bat-shaped throwing arm by pulling on said release handle to provide forcible rotation of said throwing arm by said coil spring driving means, and thereby delivering the ball from the bat-shaped throwing arm at the direction, angle and speed selected for batting practice.

5. The device, in accordance with claim 1, wherein said bat-shaped throwing arm includes a carrier having a cup and means for adjusting the angular position of the cup relatively to said carrier.

6. The ball-pitching device, in accordance with claim 5, including means within the cup for contacting and imparting a spin to the ball at the time of delivery.

7. The device, in accordance with claim 6, including means for selectively positioning said grommet means to determine the spin imparted to the ball at the time of delivery.

8. The ball-pitching device, in accordance with claim 1, wherein said detent is carried by said bat-shaped throwing arm and includes a camming section, a locking rod having a hinge and a portion engaged by said camming section to effect biasing thereof, spring means urging said portion into locking engagement with said detent and additional locking means for preventing accidental dislodgement of said locking means.

9. The device, in accordance with claim 1, wherein said bat-shaped throwing arm includes a spring means and carrier having a cup, and said spring means being adapted to impart a compound snapping action to said carrier and cup.

10. The ball-pitching device, in accordance with claim 1, including ground staking means for retaining the frame in continual ground engagement between and during pitches.

* * * * *